United States Patent [19]

Flint

[11] Patent Number: 4,716,798

[45] Date of Patent: Jan. 5, 1988

[54] CAN HOLDER AND OPENER

[76] Inventor: William L. Flint, 400 Crescent Ave., Colonial Heights, Va. 23834

[21] Appl. No.: 851,932

[22] Filed: Apr. 14, 1986

[51] Int. Cl.[4] ..... B26D 1/00

[52] U.S. Cl. ..... 83/13; 30/2; 30/124; 83/54; 83/451; 83/467 R; 269/303

[58] Field of Search ..... 30/2, 124, 136, 136.5, 30/289; 83/481, 467 R, 13, 54; 269/297, 303

[56] References Cited

U.S. PATENT DOCUMENTS

| | | | |
|---|---|---|---|
| 56,368 | 7/1866 | Chapin . | |
| 384,973 | 6/1888 | Hawes . | |
| 1,095,251 | 5/1914 | Washburne | 30/2 |
| 1,321,578 | 11/1919 | Ward . | |
| 1,397,217 | 11/1921 | Kepner . | |
| 2,770,876 | 11/1956 | Teitelbaum . | |
| 4,356,748 | 11/1982 | Tilton | 83/522 X |

*Primary Examiner*—Douglas D. Watts

*Attorney, Agent, or Firm*—Cushman, Darby & Cushman

[57] ABSTRACT

A pair of brackets is arranged side by side on a horizontal work surface so that a front flange of each extends down against a front edge of the work surface, and a rear flange of each projects upward. A large rectangular can to be opened is placed on its side on the brackets, with its bottom in engagement with the rear flanges. Side flanges on the brackets confine opposite sides of the can between them, and the top of the can is disposed at the front of the work surface. A T-handled, oblique bladed spear-like opener is then thrust piercingly longitudinally into the can through the top wall adjacent the rim. Preferably the width of the blade equals the width of the cut which needs to be made, so that four bayonet-like thrusts will neatly sever the lid from the can as a square of metal sheet. The task can be easily performed by one person, because the brackets by themselves hold the can at a convenient location for opening.

8 Claims, 4 Drawing Figures

CAN HOLDER AND OPENER

BACKGROUND OF THE INVENTION

For large volume users of consumable welding rods for electric arc welding equipment, such as industrial equipment fabricating shops, construction companies and welding service companies, the most economical way to purchase supplies of welding rods is by the sealed can. In this form, welding rods each about a foot and a half long and about one-eighth of an inch in diameter are packed several hundred to a can, bundled one deep in a plurality of rows and columns. The typical can is rounded corner rectangular in transverse cross-sectional shape, with rimmed flat ends. This typical can measures about a foot and a half tall and about six inches by about six inches in transverse cross section. The typical can is made of sheet steel with a protective coating of lacquer or the like; very approximately, it is the size and shape of a conventional two gallon gasoline can and may be made of the same kind and weight of metal sheet material.

As anyone who has ever tried to open a can of Spam luncheon meat or canned corned beef using a conventional rotary can opener has learned, it is next to impossible to neatly open a can of rounded corner rectangular transverse cross-sectional shape using such a device. And although the task of opening an especially tall can, e.g. one that is more than a foot tall is not a task that the average person is likely to have faced, it should be easy to imagine that the taller a can is, the more difficult it is to open using only conventional ways and means. For instance, if the tall can is set upright on a standard-height countertop or similar work surface, the upper end is disposed at so high a level that manipulation of a rotary type of opener about its periphery is awkward and not convenient.

Because so many cans contain a liquid or other fluid product which is likely to spill out if the can is not disposed in an upright condition as it is being opened, most peoples' experience with opening cans is confined to opening cans which are disposed in an upright condition. However, due to the tallness of cans of welding rods, and due to the fact that they are not very fluent, it is possible to open a can of welding rods while the can is lying on its side on the work surface, and some people who have the occasion to open such cans in the course of their work have gotten into the habit of lying the cans down in order to open them. A problem with using such a technique is getting the can to stay still while the lid is being cut open. Often it is a three- or four-handed task, which cannot be performed well by one person acting alone. Attempts to do so too often produce frustration, mangled cans and nasty cuts.

The present inventor is one who has had occasion to experience the conventional way that such cans are opened, to conclude that there must be a better way, and to come to believe he has found it.

SUMMARY OF THE INVENTION

A pair of brackets is arranged side by side on a horizontal work surface so that a front flange of each extends down against a front edge of the work surface, and a rear flange of each projects upward. A large rectangular can to be opened is placed on its side on the brackets, with its bottom in engagement with the rear flanges. Side flanges on the brackets confine opposite sides of the can between them, and the top of the can is disposed at the front of the work surface. A T-handled, oblique bladed spear-like opener is then thrust piercingly longitudinally into the can through the top wall adjacent the rim. Preferably the width of the blade equals the width of the cut which needs to be made, so that four bayonet-like thrusts will neatly sever the lid from the can as a square of metal sheet. The task can be easily performed by one person, because the brackets by themselves hold the can at a convenient location for opening.

The principles of the invention will be further discussed with reference to the drawing wherein a preferred embodiment is shown. The specifics illustrated in the drawing are intended to exemplify, rather than limit, aspects of the invention as defined in the claims.

DETAILED DESCRIPTION

Figure 1:
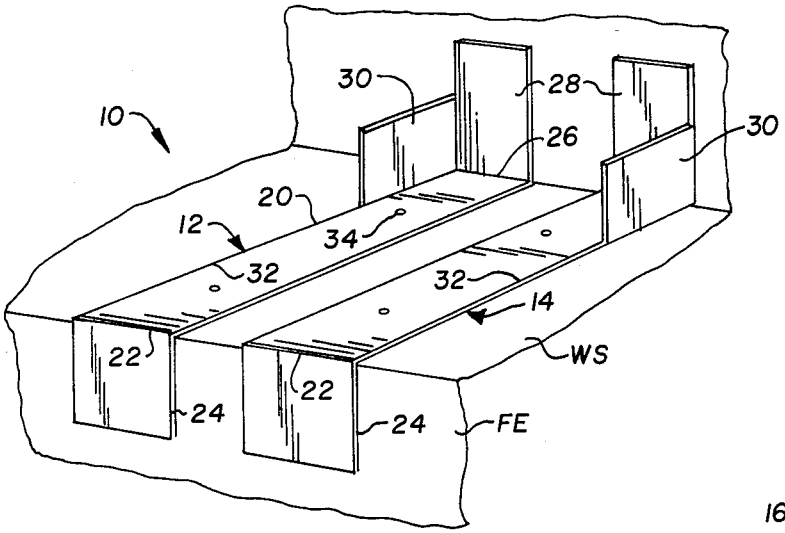
FIG. 1 is a perspective view of the brackets arranged on a work surface.
Figure 2:
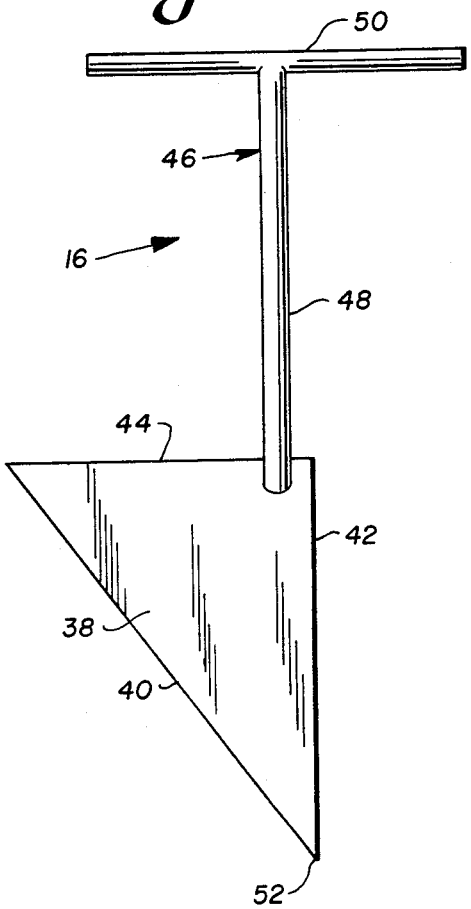
FIG. 2 is a front elevation view of the opener.
Figure 4:
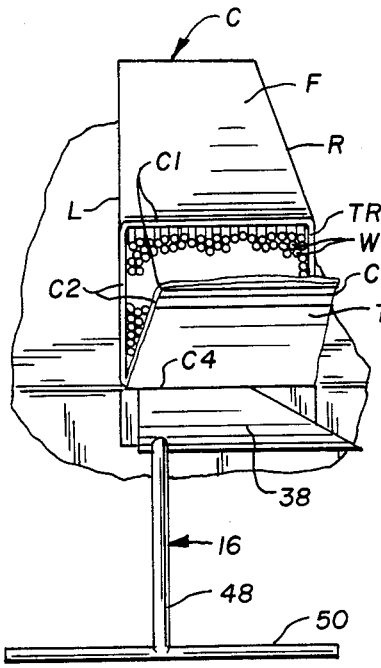
FIG. 4 is another perspective view similar to FIG. 3, but from a different angle, just as the fourth cut has completed severance of the lid from the can.

Apparatus for practicing the principles of the invention is shown in the drawings in a preferred embodiment. This apparatus is seen to include a can holder 10 comprising a pair of brackets 12, 14, and a can cutting tool 16. A typical can is illustrated at C. The apparatus 10, 16 may usefully be made of many different materials. By present preference it is fabricated out of the same type of stainless steel plate and bar stock as is conventionally used in the manufacture of hotel and restaurant kitchen counters. Fabrication techniques typically involve cutting, bending, hole drilling, welding, deburring, sharpening, and polishing.

Each bracket 12, 14 of the can holder is seen mainly to be constituted by a strap-like body 18 having a central portion 20 that is adapted to lie flat on a countertop or other horizontal, upwardly presented, elevated work surface WS which has a front edge FE. The forward end portion of each strap-like body 18 is bent down, e.g. at a right angle at 22, to provide a downwardly projecting flange or hook means 24 which is adapted to hang over and engage the front edge FE of the work surface. The rear end portion of each strap-like body 18 is bent up, e.g. at a right angle at 26, to provide an upwardly projecting flange or hook means 28 which is adapted to engage the bottom wall B of a can C, while that can is lying on its side. Lastly, each bracket 12, 14 is shown including a gusset flange 30 which extends between the rearmost couple of inches or so of the central portion 20 and the lower couple of inches or so of the upwardly projecting flange 28 on the laterally outer edge 32 of each bracket. Each gusset flange 30 thus extends in a vertical plane that is oriented parallel to the longitudinal axis of the respective bracket 12, 14.

The typical can C is of rounded-corner rectangular (e.g. square or nearly square) transverse cross-sectional shape, so that it has a front sidewall F, a rear sidewall R', a left sidewall L, a right sidewall R, a top wall T and a bottom wall B. Typically the top and bottom walls T and B are surrounded by perimetrical rims TR and BR which protrude axially slightly beyond the outer surfaces of the respective end wall of the can C.

The can C contains a product such as a bundle of welding rods WR which will not uncontrollably run out if the can C is opened while lying on its side.

The object of the process being described herein is to open the can C so that its contents WR are exposed for selective removal. Opening the can C is accomplished by cutting through the thickenss of the can wall completely along the outer perimeter of one of the can end walls, e.g. the top T.

In order to carry out that process in a preferred practice of the invention, the can holder 10 is placed on a work surface WS as shown in FIG. 1. The two brackets 12 and 14 are placed laterally apart by a sufficient amount to receive the unopened can C as shown, and the unopened can C is placed on its side with its bottom B resting against the front surfaces of the upwardly projecting flanges 28.

The two brackets 12, 14 may be positionally adjusted by moving them medially until their gusset flanges 30 engage vertical opposite sides of the can C, as shown.

(Although nothing need mount the brackets 12, 14 to one another or to the work surface, it would be within the contemplation of the invention to connect the two brackets 12, 14 as one integral member, or by an adjuster which permitted the lateral spacing between them to be adjustably fixed. And it would be within the contemplation of the invention to fixedly or removably secure the brackets 12, 14 to the counter top or the like, e.g. by means of screws or other fasteners 34, e.g. installed through corresponding openings. These further features would be especially practical for use in situations where a user had the occasion, frequently, to open numerous same-sized cans C at the same location, e.g. in a corner of the shop at a welding service company.)

By preference, the length of each central portion 20 of each bracket 12, 14 is generally equal to the distance longitudinally of the can C between the top and bottom walls T and B thereof, so that when the bottom wall of the recumbent can C is urged back into abutment with the flanges 28, and the flanges 24 are in engagement with the front edge FE of the work surface WS, the top wall T of the can C is conveniently located in or near the vertical plane of the front edge FE of the work surface WS.

The unopened can C is thus disposed in a convenient position for being opened using the cutting tool 16.

The cutting tool 16 is shown comprising a generally triangular blade 38 having an obliquely forwardly-facing sharpened cutting edge 40, a longitudinal edge 42 and a transverse, rear edge 44. A T-handle 46 is shown secured to a rear portion of the blade 38 so as to have its longitudinal portion 48 extending rearwardly, and its cross handle 50, capable of being held alternatively with one or both hands projecting crosswise at the rear of the portion 48.

The cutting tool 16 is used as a piercing-type cutter, in a way that is similar to known piercing-type can openers, such as non-rotary-type household can openers, and the small folding-type can openers that are familiar to most who have had the opportunity to eat military field rations.

By preference, the width of the blade 38, i.e. the distance from one end to the other along the transverse rear edge 44 is substantially equal to the lengths of each of the four cuts C1, C2, C3 and C4 which must be made in order to sever the top T from the can C.

Figure 3:
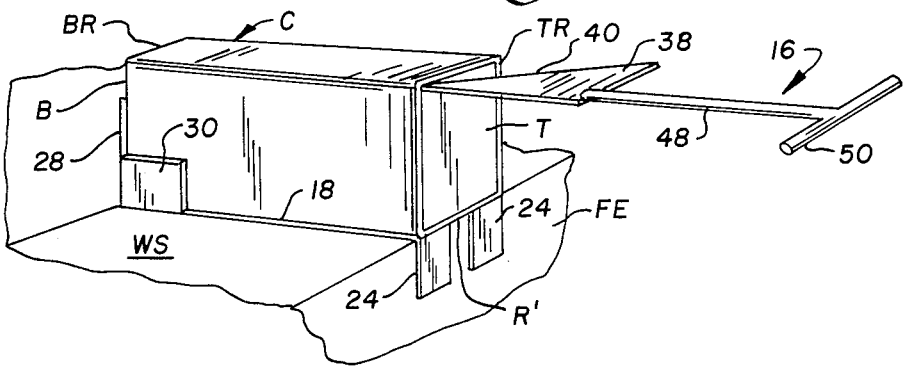
FIG. 3 is a perspective view showing coaction of the opener and brackets with the can as the can is being opened.

In such a case the can opening cutting operation involves placing the point 52 of the blade at one end of intended cut C1, and pushing the cross handle 50 toward the rear of the work surface, i.e. towards the flanges 28. By this means a bayonet-like thrust is made through the can lid, creating a cut C1. By preference, this cut is made horizontally, at the top, as shown in FIG. 3, and each successive cut is made at the same place, after lifting the can C, turning the can C ninety degrees and setting it back in the brackets. However, it would be within the concept of the invention to leave the can where it is and make the four cutter thrusts at the four sites C1, C2, C3 and C4 by moving the cutter between thrusts. After each thrust, the cutter is completely withdrawn. Upon making the fourth thrust, C4, the lid is cut free, exposing the contents WR for selective abstraction and use.

It should now be apparent that the can holder and opener as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for opening a can which has a perimetrical sidewall of generally rounded-corner rectangular transverse cross-sectional shape, extending between two opposite end walls, said method comprising:

(a) providing a generally horizontal, upwardly-facing elevated work surface with a front edge;

(b) providing at least one bracket with a front flange which engages said front edge, a body which extends rearwards along said work surface and a rear flange which projects upwards at a site spaced rearwardly of said front edge;

(c) disposing the can which is to be opened, on its perimetrical sidewall with its one end wall in engagement with said rear flange and its opposite end wall facing forwards and located nearer said front edge of said work surface; and (d) thrusting a cutter horizontally, rearwardly into said can about the outer perimeter of said opposite end wall.

2. The method of claim 1, wherein:

in conducting step (d), the cutter is repeatedly thrust into and withdrawn from said can, shifting said can relative to said cutter between at least some of said thrusts in order to completely cut said opposite end wall from said can about said outer perimeter.

3. The method of claim 2, wherein:

said outer perimeter has four sides of generally equal length; and said cutter has a blade which is as wide as a said side of said outer perimeter, so that step (d) can be fully accomplished in four thrusts of said cutter.

4. The method of claim 1, wherein:

step (b) includes providing two such brackets, with lateral spacing between them, each having a laterally outer side gusset flange, and engagingly confining opposite sites on said perimetrical sidewall between said outer side gusset flanges.

5. The method of claim 4, wherein:

step (b) further includes securing said brackets to said work surface.

6. The method of claim 1, wherein:

said can is a container of electric arc welding rods.

7. Apparatus for opening a can which has a perimetrical sidewall of generally rounded-corner rectangular transverse cross-sectional shape, extending between two opposite end walls, said apparatus comprising:

two brackets disposed with lateral spacing between them and adapted to be supported on a generally horizontal, upwardly-facing, elevated work surface having a front edge, each said bracket including a front flange which projects downwards and is adapted to engage said front edge of said work surface, a body mounting said front flange and being adapted to be supported upon and to extend rearwardly, horizontally on said work surface, and a rear flange mounted to said body and adapted to project upwardly from said body at a site spaced rearwardly of said front edge;

each said bracket being adapted to have the can which is to be opened disposed thereon on its said perimetrical sidewall with its said one end wall in engagement with said rear flange and its said opposite end wall facing forwards and located nearer said front edge of said work surface so that a cutter may be thrust horizontally, rearwardly into said can about the outer perimeter of said opposite end wall.

8. The apparatus of claim 7, wherein:

each said bracket further includes a laterally outer side gusset flange adapted to engage a respective site on said perimetrical sidewall, so that said can is braced by both said gusset flanges against lateral shifting while being cut open.

* * * * *